United States Patent [19]

Lyman

[11] Patent Number: 4,764,144

[45] Date of Patent: Aug. 16, 1988

[54] ROTATABLE ASSEMBLIES FOR INTERCONNECTING BUILDING BLOCKS

[75] Inventor: Ronald L. Lyman, Rancho Cordova, Calif.

[73] Assignee: Fantasy Toys, Inc., Fair Oaks, Calif.

[21] Appl. No.: 892,277

[22] Filed: Aug. 4, 1986

[51] Int. Cl.[4] ..... A63H 33/04

[52] U.S. Cl. ..... 446/128; 446/124

[58] Field of Search ..... 446/128, 121, 120, 95; 242/118, 125.3; 493/954

[56] References Cited

U.S. PATENT DOCUMENTS

| | | | |
|---|---|---|---|
| 2,343,389 | 3/1944 | Stahl | 493/954 |
| 2,493,435 | 1/1950 | Archambault | 446/124 |
| 2,649,803 | 8/1953 | Andre | 446/120 |
| 2,657,876 | 11/1953 | Bieber | 242/118 |
| 3,510,979 | 5/1970 | Fischer | 446/127 |
| 3,566,531 | 3/1971 | Hasel et al. | 446/120 |
| 3,670,449 | 6/1972 | Lemkin et al. | 446/124 |
| 4,012,155 | 3/1977 | Morris | 446/116 |
| 4,203,248 | 5/1980 | Tapdrup | 446/128 |
| 4,602,908 | 7/1986 | Kroeber | 446/128 |

FOREIGN PATENT DOCUMENTS

| | | | |
|---|---|---|---|
| 1264926 | 5/1961 | France | 446/128 |
| 1311992 | 11/1962 | France | 446/120 |
| 2168902 | 7/1986 | United Kingdom | 446/121 |

*Primary Examiner*—Victor N. Sakran

*Attorney, Agent, or Firm*—Harris Zimmerman; Howard Cohen

[57] ABSTRACT

Rotatable assemblies for building blocks include a wheel having a peripheral annular cylindrical surface adapted to support building blocks joined thereabout in hinged, end to end fashion, the wheel including annular flanges extending radially outwardly and spaced axially to retain the blocks therebetween. A pivot shaft extends fixedly from a first end surface of the wheel, and is disposed coaxially therewith. The opposed, second end surface includes a coaxially disposed bore dimensioned to receive a pivot shaft of another, similar wheel. A plurality of cylindrical interconnection projections extend from the second end face and are arrayed symmetrically about the bore. A plurality of socket-like interconnection receptacles are formed in the second end face and interspersed with the cylindrical projections. The first end face also includes a like plurality of interconnection receptacles disposed to engage the cylindrical projections of another like-formed wheel for stackable interconnection therebetween. The cylindrical projections also permit connection between the wheel and building blocks having similar interconnection features. A mounting block is also provided, including similar interconnection features and a plurality of shaft-engaging bores extending laterally into side portions of the mounting block.

19 Claims, 3 Drawing Sheets

ROTATABLE ASSEMBLIES FOR INTERCONNECTING BUILDING BLOCKS

BACKGROUND OF THE INVENTION

The present invention is directed to rotating wheel and tread assemblies for toy building blocks, especially building blocks having stackable interconnection features as well as hinged, interconnecting end features. One such system of building blocks is disclosed in U.S. patent application Ser. No. 621,232, now U.S. Pat. No. 4,606,732 issued to Ronald Lyman. (The entirety of this patent is incorporated herein by reference) This prior art building block system includes a plurality of blocks, each having an array of cylindrical projections extending from one surface, and a like array of socket-like receptacles extending from the opposed surface for stackable interconnection with other blocks. Also, each block includes a pair of hinge arms extending from one end, witha pair of detent knobs formed on the arms, and a pair of recesses formed at the other end of each block and adapted to engage the hinge knobs of like blocks in snap-engaging, pivoting fashion.

As a result of such interconnection features, the blocks may be fashioned into assemblies which are stacked in non-orthogonal fashion, or formed into flexible, bendable, end-to-end chains which describe arcuate formation, curves, and closed loops. Indeed, such loops may be rotatable and movable to create rotating rings, belt-like loops, and the like. Due to the fact that such building block systems are relatively new to the art, there are no wheel assemblies available which exploit the pivotability, mobility, and rotatability of such rings, loops, and other curved block constructions. Clearly there is a need for wheel assemblies adapted to this use, to maximize the creative and recreational potential of hinged building block systems.

SUMMARY OF THE PRESENT INVENTION

The present invention generally comprises wheel assemblies and like pivoting and rotating structures adapted for use with hinged block construction systems.

The rotatable assemblies include a wheel having a peripheral annular cylindrical surface adapted to support building blocks joined thereabout in hinged, end to end fashion, the wheel including annular flanges extending radially outwardly and spaced axially to retain the blocks therebetween. A pivot shaft extends fixedly from a first end face of the wheel, and is disposed coaxially therewith. The opposed, second end face includes a coaxially disposed bore dimensioned to receive a pivot shaft of another, similar wheel. A plurality of cylindrical interconnection projections extend from the second end face and are arrayed symmetrically about the bore. A plurality of socket-like interconnection receptacles are formed in the second end face and interspersed with the cylindrical projections. The first end face also includes a like plurality of interconnection receptacles disposed to engage the cylindrical projections of another like-formed wheel. Thus any two end faces of any two confronting wheel can be joined in generally flush engagement, so that pivot shafts may extend axially from both ends or one of the two-wheel assembly.

The cylindrical projections also permit connection between any wheel and building blocks having similar interconnection features. That is, the second end face of any wheel (opposite the shaft-bearing end face) may be joined to either the cylindrical projections or to the receptacles of building blocks having like interconnection features. The rotatable assembly system also includes a mounting block having similar interconnection features (snap engaging projections and receptacles) and a plurality of shaft-engaging bores extending laterally into side portions of the mounting block. The mounting block may be incorporated into a block structure using the aforementioned interconnection features, and the pivot shaft of a wheel member engaged in one of the bores in the mounting block in snap-engaging, freely rotating fashion. In this configuration the wheel is adapted to rotate about the pivot shaft with the first end face thereof confronting the mounting block, and the second end face either extending freely or joined to another block assembly. In the latter case the wheel provides the function of a bearing, joining the two separate block constructions with free relative rotation about a relatively fixed axis therebetween.

The wheel may also be connected to a block structure using the interconnection features of the second end surface to join to like features of like blocks in fixed relationship. In such configuration a chain of hingedly connected blocks may be secured about the fixed wheel in belt or loop fashion, and urged to circulate about the fixed wheel in sliding translation thereabout. Also, the outwardly extending first end face of the wheel can be joined to further wheels in stacked axial relationship to provide relative rotation therebetween.

Also, the mounting block described above may be provided with hinged end connector features similar to the building blocks of the system. It is then possible to connect the mounting block to a relatively fixed block construction in hinged relationship therebetween, so that a wheel pivot shaft may be engaged in a bore of the mounting block and disposed to freely rotate about an axis which is itself pivotable about the mounting block hinged interconnect.

Thus it is apparent that the wheel assembly components of the present invention provide a wide variety of rotatable and pivotal assemblies in various combinations. These varied kinetic assemblies may be joined in a virtually infinite number of combinations and permutations to provide a rich addition to the expressive possibilities of toy building blocks.

DESCRIPTION OF THE PREFERRED EMBODIMENT

Figure 1:
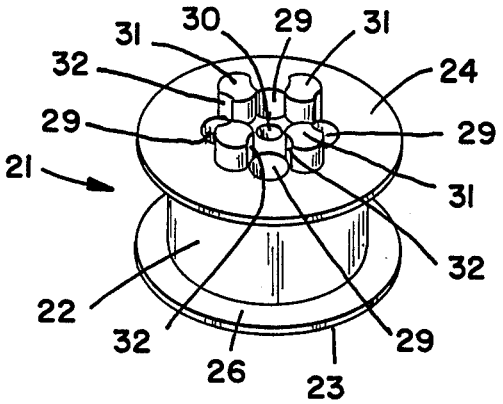
FIG. 1 is a perspective view of one end surface of the wheel member of the present invention.
Figure 2:
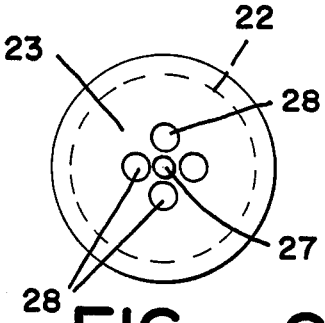
FIG. 2 is an end elevation of one end of the wheel member depicted in FIG. 1.
Figure 3:
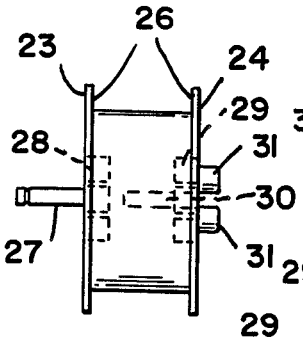
FIG. 3 is a side elevation of the wheel member depicted in FIGS. 1 and 2.
Figure 4:
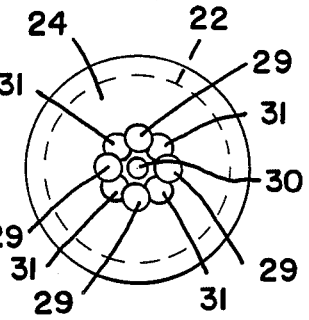
FIG. 4 is an end elevation of the other end of the wheel member depicted in FIGS. 1–3.

The present invention generally comprises construction block components for forming wheel assemblies and like pivoting and rotating structures. The invention is adapted for use with hinged block construction systems, although it can be employed advantageously with many forms of building blocks known in the prior art. A key component of the present invention comprises a wheel member 21, as shown in FIGS. 1–4. The wheel member 21 includes a generally cylindrical peripheral curved panel 22, and disk-like end panels 23 and 24 joined to axially opposed ends of the panel 22. The end panels are disposed coaxially with the panel 22, and are greater in diameter to define a pair of axially spaced annular flanges 26 extending radially from the opposed ends of the wheel. The axial spacing of the flanges 26 is sufficient to accommodate the width dimension of hinged interconnecting blocks as described in U.S. Pat. No. 4,606,732 mentioned in the preceding description.

Extending outwardly from the end panel 23 is a generally rigid pivot shaft 27, disposed axially with respect to the cylinder 22 and the end panel itself. A quartet of generally cylindrical socket-like receptacles 28 are formed in the end panel, and arrayed symmetrically with respect to the shaft. The receptacles are disposed at equal distances from the shaft 27 and at equal angles thereabout. The other end panel 24 is provided with a bore 30 extending axially therein and dimensioned to receive a pivot shaft 27 of another like-formed wheel in freely rotating fashion. The end panel 24 is also provided with a quartet of receptacles 29 virtually identical to the receptacles 28 and arrayed in like manner in equal spacing about the bore 30. However, the end panel 24 further includes a quartet of cylindrical projections 31, each interspersed between a pair of receptacles 29. The projections 31 are dimensioned to interconnect with the receptacles 28 or 29 of other like-formed wheels. Furthermore, the projections are provided with axially extending arcuate cutouts 32 to permit the interdigitation of projections 31 with like projections of similarly formed wheels.

Figure 5:
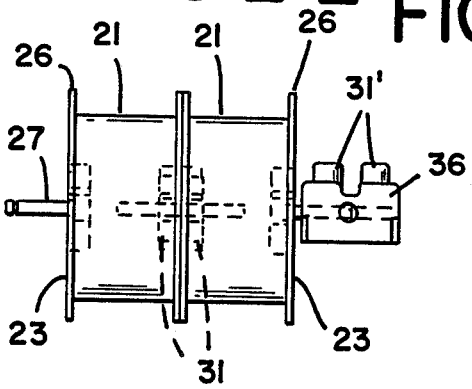
FIG. 5 is a side elevation showing two wheel members joined in axially stacked assembly and joined also to a mounting block of the present invention.
Figure 7:
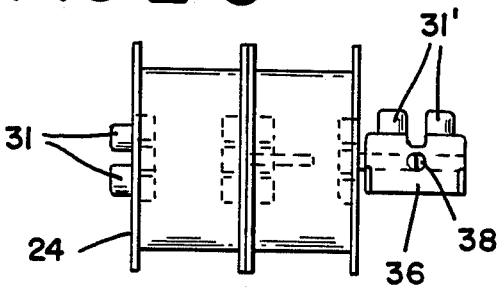
FIG. 7 is a side elevation showing an alternative combination of two wheel members joined in axially stacked assembly and joined also to a mounting block.
Figure 8:
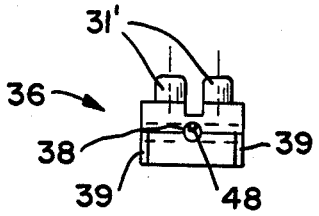
FIG. 8 is an end elevation of the mounting block member of the present invention.
Figure 9:
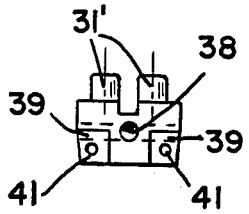
FIG. 9 is a side elevation of the mounting block member depicted in FIG. 8.
Figure 10:
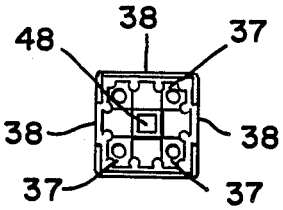
FIG. 10 is a bottom view of the mounting block member shown in FIGS. 8 and 9.

The end panel features described above permit the direct end-to-end connection of a plurality of wheels 21 in many different stacked assemblies. For example, as shown in FIG. 5, the cylindrical projections 31 of one wheel may be interdigitated with the projections 31 of another wheel, and the confronting end surfaces 24 urged together so that the projections 31 of each are received in the receptacles 29 of the other. In this configuration the pivot shafts 27 of the two assembled wheels extend axially outwardly in opposite directions from the assembly. Alternatively, two wheel may be joined with the end surface 24 of one confronting the end surface 23 of the other, as shown in FIG. 7. In this configuration the pivot shaft of the latter is received in the bore of the former, and the projections 31 of the former received in the receptacles 28 of the latter. In this configuration the assembly provides one pivot shaft 27 extending therefrom, and one surface 24 facing exteriorly in the opposite direction and available to be interconnected with other wheels or with blocks having similar projections and receptacles for interconnection. Furthermore, a plurality of more than two wheels may be assembled using either or both of the configurations of FIGS. 5 and 7, as suits the creative needs of the individual using the components.

The present invention also includes a mounting block 36 adapted for use with the wheel (or wheels) 21. Each block 36 comprises a generally rectangular solid object having an array of cylindrical projections 31′ extending from the upper end thereof and a like array of socket-like receptacles 37 formed in the bottom end, the receptacles being adapted to receive and engage the projections 31 of the wheels or the projections 31′ of likformed mounting blocks 36 for stacked interconnection therebetween. Furthermore, the toy building block system described in the United States Patent enumerated above includes blocks having like interconnection features, so that the mounting block 36 may be incorporated into a block construction according to that prior art system.

Figure 18:
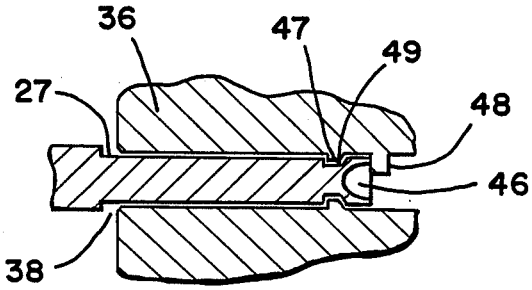
FIG. 18 is a cross-sectional elevation showing the engagement of a wheel assembly pivot shaft in a mounting block bore of the present invention.

A salient feature of the mounting block 36 is the provision of a plurality of shaft-engaging bores 38, each extending laterally into one of the side panels of the rectangular block 36. Each bore 38 is dimensioned to receive therein a pivot shaft 27 in freely rotating fashion, as shown in FIGS. 5 and 7. With regard to FIG. 18, it should be noted that the distal end of each shaft 27 is provided with a concave recess 46 extending into the end face thereof. Each shaft is also provided with a tapered annular groove 47 disposed slightly proximally of the inner extent of the concave recess 46. The recess 46 and groove 47 act cooperatively to permit the elastic radial compression of the distal end of the shaft 27.

Each bore 38 in a mounting block 36 includes a flange 49 disposed at the inner end of the bore and extending radially inwardly. The flange 49 is dimensioned to form an interference fit with the distal end of a shaft 27, compressing the distal end radially as it is inserted thereby and snap-engaging the annular groove 47. The snap-engagement of the groove is provided with sufficient clearance to define a freely rotating engagement of the shaft. However, it should be noted that the shaft cannot be removed from the bore without first exerting sufficient axial force to urge the distal shaft portion past the constriction formed by the flange 49. Thus the shaft is retained and prevented from inadvertent withdrawal, although it rotates freely and can be removed with moderate manual effort. Furthermore, a knob-like stop 48 extends perpendicularly with respect to the axis of the bore 38 and limits the inward travel of the shaft 27 in the bore 38.

Figure 6:
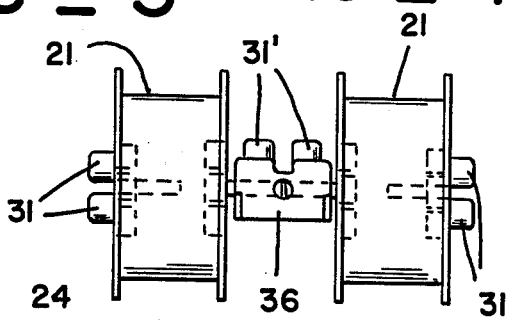
FIG. 6 is a side elevation of two wheel members joined to an intermediate mounting block of the present invention.

A mounting block 36 may be disposed intermediately of a pair of wheels 21 and used to join the wheels in spaced apart, axial alignment, as shown in FIG. 6. Also, one or more of the wheel members 21 of the present invention may be supported by mounting blocks 36 incorporated in the building block system referenced above.

Figure 11:
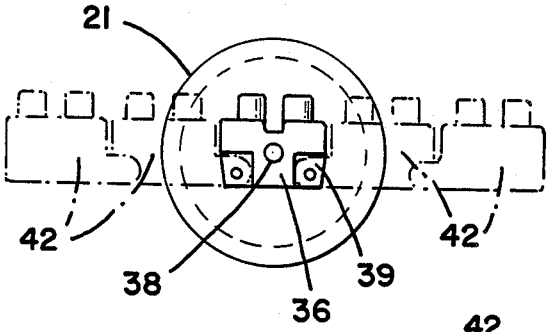
FIG. 11 is a side elevation of a mounting block joined to a wheel member in freely rotating fashion.
Figure 12:
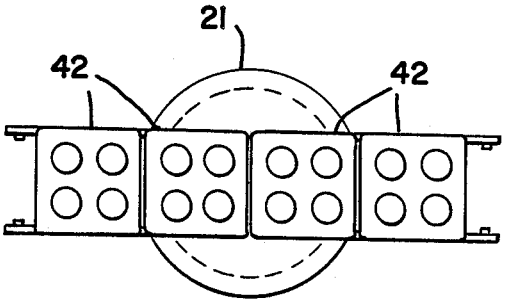
FIG. 12 is an end elevation of mounting blocks joined to a wheel member in fixed engagement.
Figure 15:
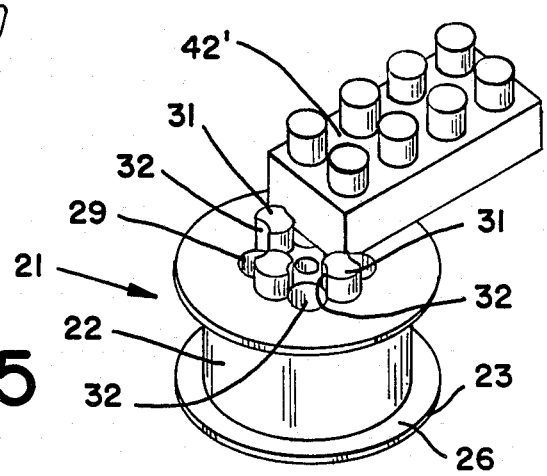
FIG. 15 is a side view of a wheel member connected to a building block in interdigitating fashion.
Figure 16:
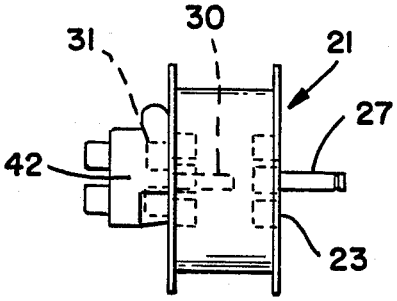
FIG. 16 is a side view of a wheel member connected to a building block with the projections of the wheel member engaged in the socket receptacles of the block in snap-engaging fashion.

Furthermore, each of the mounting blocks 36 includes hinged interconnecting end features of the referenced patent; i.e., two pair of arcuate recesses 39, each pair disposed at lower corner positions of each side, adjacent to the end walls. Each recess includes a detent recess 41 adapted to engage the pivot arms and detent knobs of the blocks 42 of the referenced building block system. Thus each mounting block 36 may also be joined in hinged, pivoting fashion to a chain or array of such building blocks 42, as shown in FIG. 11. Alternatively, the blocks 42 may be joined to a wheel 21 using the receptacles of the blocks 42 to receive and engage the projections 31 of the wheel, as shown in FIGS. 12 and 16. In this latter configuration the wheel is non-rotatable with respect to the block construction. However, as shown in FIG. 15, one projection 31 may be snap-engaged in one receptacle of a building block 42', joining the two components in freely rotating fashion.

Figure 17:
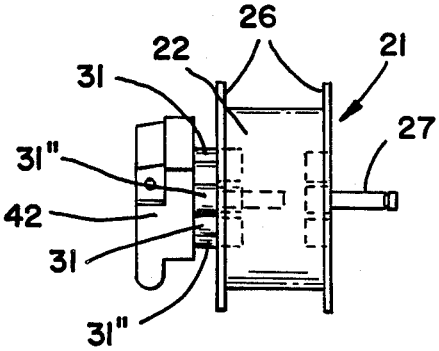
FIG. 17 is a side view of a wheel member connected to a building block with the projections of the wheel member interdigitated with the projections of a building block.

It may be appreciated that the components of the present invention provide wheel members which may be joined together in myriad possible combinations, such as stacks of wheels in axial alignment, one or more wheels supported in rotating fashion by a mounting block, and/or one or more mounting blocks supported either hingedly or fixedly in a construction of blocks 42. The wheels may also be directly joined to a construction of blocks 42. To add to this array of possibilities, the projections 31" of a block 42 may be interdigitated with the projections 31 of a wheel 21 to form an interconnection therebetween, as shown in FIG. 17. Thus the limitations of typical prior art block systems can be overcome, especially concerning not only which surfaces of particular blocks can be interconnected, but also the limitations on arcuate structures and pivoting structures of such systems. And the present invention achieves this structural freedom using an absolute minimum of differing components.

Figure 13:
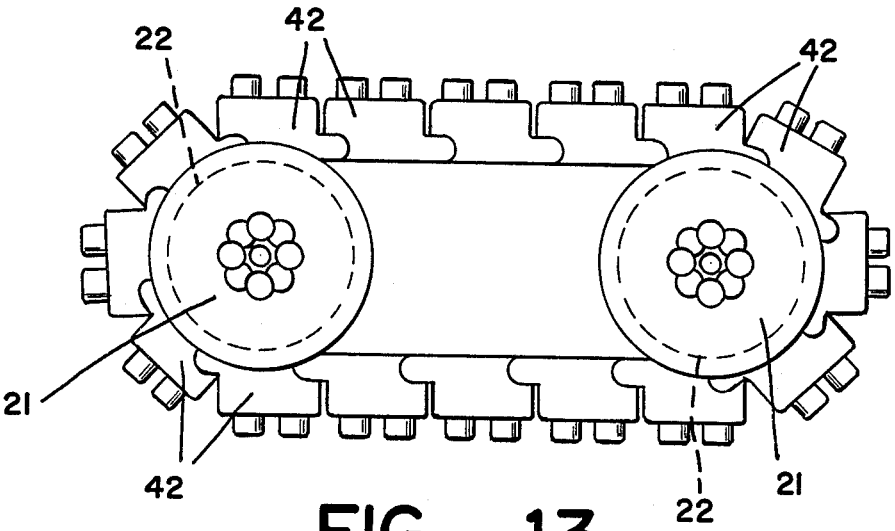
FIG. 13 is a side elevation of a rotating belt assembly formed of two wheel assemblies of the present invention and a chain of hingedly connected blocks joined in a loop.
Figure 14:
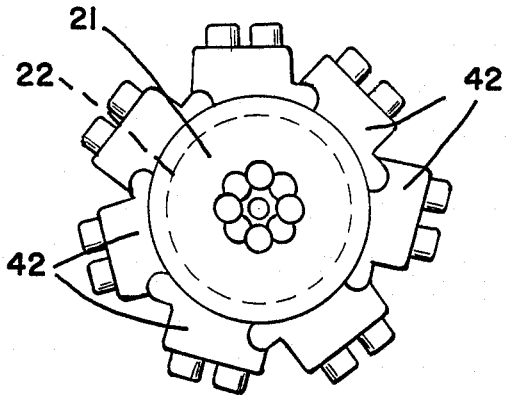
FIG. 14 is a side elevation of a wheel construction in which a ring of hingedly connected blocks are connected about one wheel member of the present invention.

As one example of an entertaining structure which may be formed with the present invention, a pair of wheels 21 may be secured to spaced mounting blocks incorporated into a block structure. A chain of blocks 42 may be secured about the wheels 21 in endless loop fashion, as shown in FIG. 13, forming a belt which may be circulated about the wheels to provide a close representation of a caterpiller tractor tread, a conveyor belt, drive belt, bicycle chain, or the like. It should also be noted that the wheels are formed of a plastic material having a low coefficient of friction, so that the loop of blocks 42 will translate easily about the wheels 21 even though the wheel may be fixedly secured to the block construction.

As another example, a plurality of the blocks 42 may be secured about a single wheel 21 to form an endless loop thereabout. This construction may be used to represent a gear wheel, tire tread, or the like, and will also rotate about the wheel whether or not the wheel is fixed other block structures. Indeed, the combinations of stacked wheel assemblies, wheel and mounting block assemblies, and wheel and building block assemblies is infinite, and cannot be enumerated herein.

Thus the present invention provides an enormous addition to the possibilities of structural representations in building block art, limited only by the imagination of the child or adult using the invention and the number of wheels and blocks available.

I claim:

1. A rotatable assembly for building blocks, including a wheel having a peripheral annular cylindrical surface and opposed end faces, a pivot shaft extending fixedly from one end face of said wheel and disposed coaxially with said cylindrical surface, and a bore extending into the other, opposed end face and dimensioned to receive a pivot shaft of another, like-formed wheel, said bore being disposed coaxially with said pivot shaft ,and interconnection means disposed about said bore in said other end face for joining said other end face to a corresponding end face of a like-formed wheel in rotationally fixed fashion with the pivot shafts of the joined wheels extending outward in opposed, coaxial fashion.

2. The rotatable assembly of claim 1, wherein said interconnection means includes a first plurality of generally cylindrical interconnection projections extending from said other end face and arranged generally equidistantly about said bore.

3. The rotatable assembly of claim 2, further including a plurality of socket-like interconnection receptacles formed in said one end face of said wheel and dimensioned and arrayed to interconnect with said cylindrical interconnection projections of another, like-formed wheel.

4. The rotatable assembly of claim 1, further including a pair of annular flanges extending radially outwardly from said end faces of said wheel and spaced axially to receive and guide a plurality of building blocks joined thereabout in hinged, end to end fashion.

5. The rotatable assembly of claim 2, further including first and second disk-like end panels joined to opposed ends of said generally cylindrical surface, each defining said one and said other end face, respectively.

6. The rotatable assembly of claim 5, wherein said end panels are greater in diameter than said generally cylindrical surface to define a pair of annular flanges extending radially outwardly and spaced apart axially.

7. The rotatable assembly of claim 1, further including a mounting block comprising a generally rectangular object having opposed side walls joined by opposed end walls in orthogonal relationship, and a plurality of pivot shaft-engaging bores extending laterally into said side walls and end walls, said bores each being dimensioned to receive and releasably retain a pivot shaft of a wheel in freely rotating fashion.

8. The rotatable assembly of claim 1, wherein said pivot shaft includes means at the distal end thereof for undergoing elastic radial compression for snap-engagement in a bore dimensioned to receive said pivot shaft.

9. The rotatable assembly of claim 8, wherein said means for undergoing elastic radial compression include a concave recess formed in the distal end face of said pivot shaft.

10. The rotatable assembly of claim 9, further including an annular groove formed in the distal end portion of said pivot shaft and spaced axially adjacent to said concave recess.

11. The rotatable assembly of claim 9, wherein said annular groove includes a tapering side wall.

12. The rotatable assembly of claim 8, wherein said bore dimensioned to receive said pivot shaft includes a flange disposed at the inner end thereof and dimensioned to snap-engage said means at said distal end of said pivot shaft for undergoing elastic radial compression.

13. The rotatable assembly of claim 10, wherein said bore dimensioned to receive said pivot shaft includes a flange disposed at the inner end thereof and dimensioned to snap-engage in said annular groove to retain said pivot shaft in said bore in freely rotating fashion.

14. The rotatable assembly of claim 2, further including a building block comprising a generally rectangular object having a bottom face, a plurality of socket-like interconnection receptacles extending into the bottom face of said building block, each of said receptacles adapted to snap engage one of said cylindrical projections of said wheel in singular fashion to join said wheel and said building block in rotatable relationship, all of said receptacles disposed to engage said plurality of cylindrical projections simultaneously to join said wheel and said building block in fixed relationship.

15. A rotatable assembly for building blocks, including a wheel having a peripheral annular cylindrical surface adapted to support building blocks joined thereabout in hinged, end to end fashion, a pivot shaft extending fixedly from one end of said wheel and disposed coaxially with said cylindrical surface, and a bore extending into the other, opposed end face and dimensioned to receive a pivot shaft of another, like-formed wheel, said bore being disposed coaxially with said pivot shaft, a mounting block comprising a generally rectangular object having opposed side walls joined by opposed end walls in orthogonal relationship, and a plurality of pivot shaft-engaging bores extending laterally into said side walls and end walls, said bores each being dimensioned to receive and releasably retain a pivot shaft of a wheel in freely rotating fashion, and a plurality of cylindrical interconnection projections extending upwardly from the upper face of said mounting block, and a like plurality of socket-like interconnection receptacles extending into the bottom face of said mounting block and dimensioned and arrayed to interconnect with the cylindrical interconnection projections of a like-formed toy building block or mounting block.

16. The rotatable assembly of claim 15, said mounting block further including means for hinged interconnection with toy building blocks having spaced pivot arms extending therefrom with detent knobs formed on said arms.

17. The rotatable assembly of claim 16, wherein said last mentioned means includes at least one pair of recesses formed in opposed side wall of said mounting block, and a pair of detent holes, each extending into one of said detent recesses and dimensioned to receive a detent knob in snapconnecting, freely rotating fashion.

18. A rotatable assembly for building blocks, including a wheel having a peripheral annular cylindrical surface adapted to support building blocks joined thereabout in hinged, end to end fashion, a pivot shaft extending fixedly from one end of said wheel and disposed coaxially with said cylindrical surface, and a bore extending into the other, opposed end face and dimensioned to receive a pivot shaft of another, like-formed wheel, said bore being disposed coaxially with said pivot shaft, a first plurality of generally cylindrical interconnection projections extending from said other end face and arrayed generally equidistantly about said bore, a plurality of socket-like interconnection receptacles formed in said one end face of said wheel and dimensioned and arrayed to interconnect with said cylindrical interconnection projections of another, like-formed wheel, and a second plurality of socket-like interconnection receptacles formed in said other end face of said wheel and interspersed with said cylindrical projections extending therefrom, said second plurality of receptacles being dimensioned and arrayed to interconnect with said cylindrical projections of another, like-formed wheel.

19. A rotatable assembly for building blocks, including a wheel having a peripheral annular cylindrical surface and opposed end faces, a pivot shaft extending fixedly from one end face of said wheel and disposed coaxially with said cylindrical surface, and a bore extending into the other, opposed end face and dimensioned to receive a pivot shaft of another, like-formed wheel, said bore being disposed coaxially with said pivot shaft, and first interconnection means disposed about said bore in said other end face for joining said other end face to a corresponding end face of a like-formed wheel in rotationally fixed fashion with the pivot shafts of the joined wheels extending outward in opposed, coaxial fashion, a mounting block having opposed side walls joined by opposed end walls, at least one pivot shaft-engaging bore extending laterally into said block walls, said bore being dimensioned to receive and releasably retain a pivot shaft of a wheel in freely rotating fashion, said block further including second interconnection means in said walls thereof configured to releasably engage said first interconnection means of said wheel.

* * * * *